US009809379B2

(12) United States Patent
Cardoso

(10) Patent No.: US 9,809,379 B2
(45) Date of Patent: Nov. 7, 2017

(54) BEVERAGE CARTRIDGE

(71) Applicant: 1675119 ONTARIO INC., London (CA)

(72) Inventor: Daniel Goncalves Cardoso, London (CA)

(73) Assignee: 1675119 Ontario Inc., London (CA)

( * ) Notice: Subject to any disclaimer, the term of this patent is extended or adjusted under 35 U.S.C. 154(b) by 156 days.

(21) Appl. No.: 13/957,895

(22) Filed: Aug. 2, 2013

(65) Prior Publication Data

US 2014/0037802 A1 Feb. 6, 2014

Related U.S. Application Data

(60) Provisional application No. 61/679,148, filed on Aug. 3, 2012.

(51) Int. Cl.

| | |
|---|---|
| ***B65D 85/804*** | (2006.01) |
| ***B65B 5/06*** | (2006.01) |
| ***B65B 7/00*** | (2006.01) |

(52) U.S. Cl.

CPC ..... *B65D 85/8043* (2013.01); *B65B 5/06* (2013.01); *B65B 7/00* (2013.01)

(58) Field of Classification Search

CPC .... B65D 85/8043; B65D 21/00; B65D 21/02; B65D 21/0209; B65D 21/0212;

(Continued)

(56) References Cited

U.S. PATENT DOCUMENTS 6,142,384 A * 11/2000 Shafik ..... C02F 1/002 210/282
6,439,529 B1 * 8/2002 Wong ..... 248/346.01

(Continued)

FOREIGN PATENT DOCUMENTS

CA 2765325 A1 12/2010
GB 2480829 A 12/2011

(Continued)

OTHER PUBLICATIONS

Weyand, T.; Partial search report from related European Application No. 13185805.2; search completed Nov. 24, 2014.

*Primary Examiner* — Erik Kashnikow
*Assistant Examiner* — Ericson M Lachica
(74) *Attorney, Agent, or Firm* — Blake, Cassels & Graydon LLP; Thomas Yau-Tsun Wong

(57) ABSTRACT

A cartridge for preparing a beverage comprises a container, a pod for containing a substance from which a beverage is to be extracted, a separating element for protecting the pod, and one or more supporting elements for holding the separating element in a preferred position. The cartridge is of the type which is pierced by at least one piercing tool to allow the injection of a liquid and extraction of a beverage. The separating element comprises a platform upon which the pod is disposed. The platform forms a boundary within the container, thereby defining first and second portions of the container. Liquid is injected into the first portion of the container, and the beverage is removed from the second portion. The separating element is positioned an appropriate distance from the piercing tools by the supporting elements.

15 Claims, 13 Drawing Sheets

(58) Field of Classification Search
CPC ..... B65D 21/0213; B65D 21/0215; B65D 21/0216; B65D 21/0234; B65D 21/0235; A47G 29/00; A47G 29/08; A47G 21/188; A47G 21/18; B44D 3/12; A47F 7/0021; A47F 7/0028; A47B 81/02; B65B 29/02; B65B 5/06; B65B 7/00; A47J 31/06
USPC ..... 426/77; 211/65
See application file for complete search history.

(56) References Cited

U.S. PATENT DOCUMENTS

| | | | | |
|---|---|---|---|---|
| 6,607,762 | B2 | 8/2003 | Lazaris et al. | |
| 6,645,537 | B2 | 11/2003 | Sweeney et al. | |
| 6,810,788 | B2 | 11/2004 | Hale | |
| 2006/0280841 | A1* | 12/2006 | Cai | A47J 31/14 426/77 |
| 2007/0062892 | A1* | 3/2007 | Donnellan | 211/74 |
| 2008/0216666 | A1* | 9/2008 | Doglioni Majer | 99/295 |
| 2009/0039006 | A1* | 2/2009 | Chung | C02F 1/002 210/226 |
| 2009/0126577 | A1 | 5/2009 | Ternite | |
| 2010/0303964 | A1 | 12/2010 | Beaulieu et al. | |
| 2011/0274802 | A1* | 11/2011 | Rivera | 426/431 |
| 2012/0006205 | A1 | 1/2012 | Vanni | |
| 2012/0070542 | A1* | 3/2012 | Camera et al. | 426/77 |
| 2012/0201933 | A1* | 8/2012 | Dran et al. | 426/80 |
| 2013/0045307 | A1* | 2/2013 | Safai | A47J 31/3676 426/77 |

FOREIGN PATENT DOCUMENTS

| | | | |
|---|---|---|---|
| WO | 2004071899 | A1 | 8/2004 |
| WO | 2006030461 | A1 | 3/2006 |
| WO | 2013136210 | A1 | 9/2013 |
| WO | 2014043106 | A1 | 3/2014 |

* cited by examiner

BEVERAGE CARTRIDGE

CROSS-REFERENCE TO RELATED APPLICATIONS

This application claims priority from U.S. Provisional Patent Application Ser. No. 61/679,148, filed on Aug. 3, 2012, the entire contents of which are incorporated herein by reference.

DESCRIPTION OF THE FIELD

The invention relates to cartridges for preparing beverages and methods of manufacturing such cartridges.

BACKGROUND OF THE INVENTION

It is known to prepare beverages by the use of cartridges by piercing the cartridge at entrance and exit points to allow passage of a liquid through a substance contained within the cartridge. While passing through the substance under pressure, the liquid extracts the desired aromas and flavours.

The substance is often held within a filter or pod which is secured within the cartridge. The pod is water-permeable, and may be made of a material which can be torn by the piercing elements that create the entrance and exit points. There is also a risk of damage to the pod due to high pressures within the cartridge.

There are proposals that separate the pod from the portions of the container that are pierced. However, some such proposals can require high manufacturing costs.

It is an object of the invention to obviate or mitigate one or more of the disadvantages described above.

SUMMARY OF THE INVENTION

According to one aspect of the invention, a cartridge for the preparation of beverages is provided, wherein the cartridge comprises a container for defining an interior space, a separating element for defining two portions of the interior space, one or more supporting elements for positioning the separating element in a desired location, and a pod for containing the substance from which the beverage is to be extracted. The separating element is constructed to allow fluid communication between the first and second portions of the interior space. The pod is disposed on the separating element.

The separating element is formed separately from the container and disposed within the container as an unaffixed piece. Similarly, the pod is supported only by the separating element. It is believed that this may reduce manufacturing costs, since the pod and separating element will remain in place without any fasteners or adhesives. Thus, steps of affixing the pod and the separating element to the container are not required.

BRIEF DESCRIPTION OF THE DRAWINGS

Embodiments of the invention will now be described by way of example only with reference to the accompanying drawings.

DETAILED DESCRIPTION

For the purpose of the discussion of the present invention, the word "form" and any of its derivatives, including but not limited to the words "formed" and "forming", are defined to mean any method or any step of a method of creating an article. For example, "form" includes, but is not limited to, injection moulding, deep drawing, punching, compression forming, vacuum forming, heat sealing, and ultrasonic welding. The method may furthermore comprise multiple steps, such as in the case that a first component of an article is manufactured, and a second manufactured component is then affixed to the first component.

Additionally, the phrase "formed around" may include any method of manufacturing which results in an article comprising a first component contained within a second component. That is, "formed around" includes, but is not limited to, the following processes: the process of forming a first element, forming a first component of a second element, disposing the first element within the first component of the second element, forming a second component of the second element, and affixing the second component to the first component; the process of suspending a first element within a medium, moulding a second element around the medium, and removing the medium from within the second element; and the process of forming a fully enclosed first element, opening the first element, placing a second element into one portion of the first element, and closing the first element.

Figure 1:
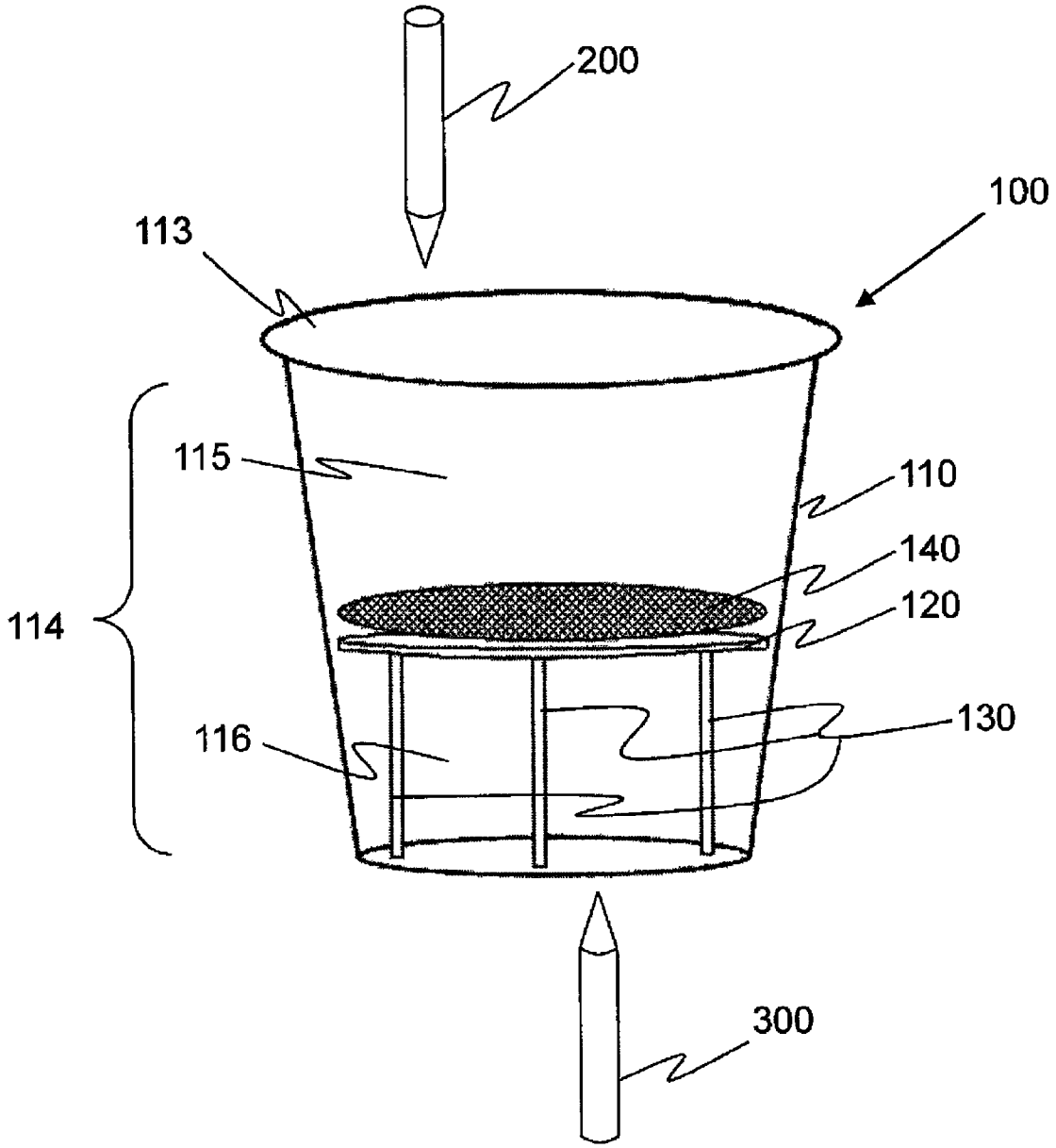
FIG. 1 is a front view of the cartridge and its components.
Figure 2:
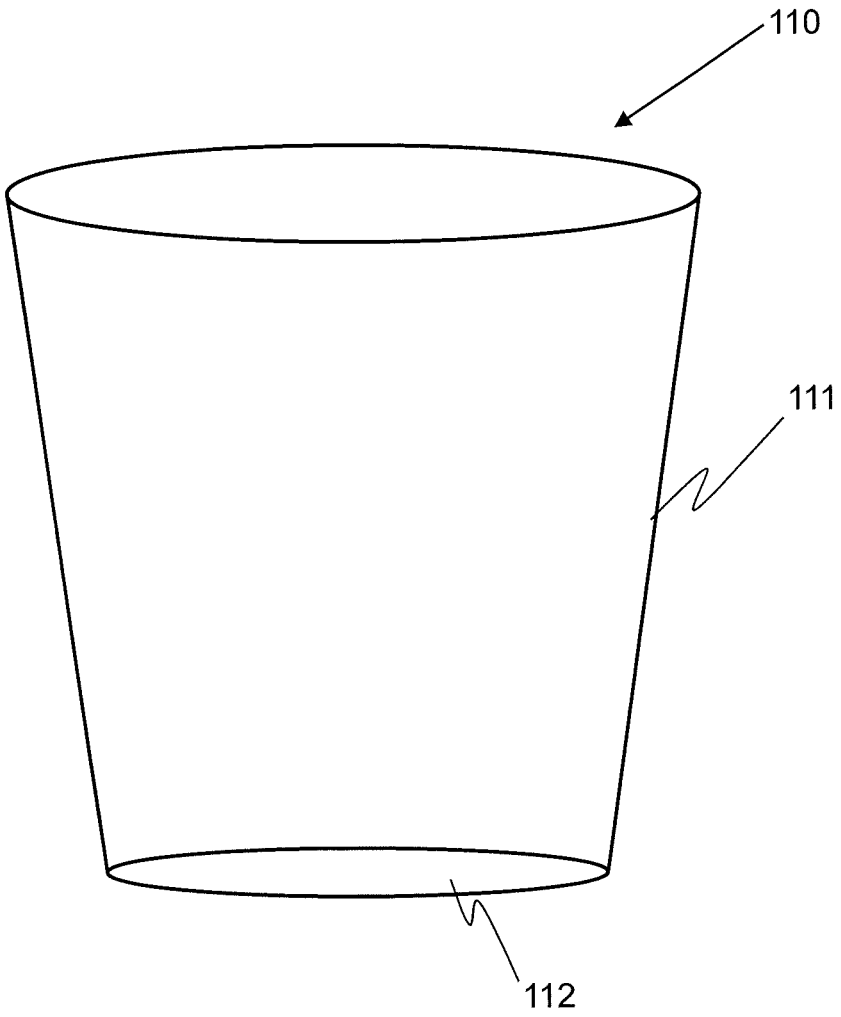
FIG. 2 is a front view of the container.

Referring to FIGS. 1 and 2, there is shown a cartridge 100 for preparing a beverage. The cartridge comprises a container 110, a separating element 120, one or more supporting elements 130, and a pod 140 containing a powder, grounds, or other substance from which the beverage may be extracted, such as ground coffee beans or tea leaves, for example. The pod 140 can include a filter, sachet, or other bag that is permeable to fluids while retaining the substance (from which the beverage may be extracted) within it.

The container 110 comprises one or more side walls 111 extending between a lid 113 at a first end and a bottom surface 112 at a second opposing end, defining an interior space 114. The separating element 120 separates the interior space 114 into a first portion 115 and a second portion 116 while permitting fluid communication between the first portion 115 and second portion 116. The pod 140 is disposed on the separating element 120, and thereby maintains its position in the first portion 115 of the interior space 114. There may be no requirement of a fastening means to fasten the pod 140 to the separating element 120 or the container 110, particularly as it may rest upon the separating element 120 when the cartridge 100 is in use. Optionally, a beverage additive may be disposed loosely, or in a second pod, between the separating element 120 and the bottom surface 112 within the second portion 116. The beverage additive, may, for example, be a powdered cream or milk, or cream or milk replacement, non-dairy cream, foam cream, sugar, chocolate, essence, mint powder, or other foods or substances. The beverage additive may be added to enhance the flavour, nutrients, appearance and/or aroma of the resulting beverage.

In use, the cartridge 100 is placed in a machine which injects a liquid into the first portion 115 of the interior space 114 by means of an inlet. The inlet can be formed by a piercing element of the machine which can also inject the liquid. While passing, under pressure, through the pod 140, the liquid extracts the desired aromas and flavours from the substance. The resulting flavoured beverage is communicated by the separating element 120 and into the second portion 116 of the interior space 114 by the pressure, gravity and/or other motive force. If a beverage additive has been disposed between the separating element 120 and the bottom surface 112, the flavoured beverage mixes with the beverage additive. The flavoured beverage then exits the cartridge 100 by an outlet, which can also be formed by a piercing element. The flavoured beverage may then pass into a beverage receptacle for consumption.

Figure 3:
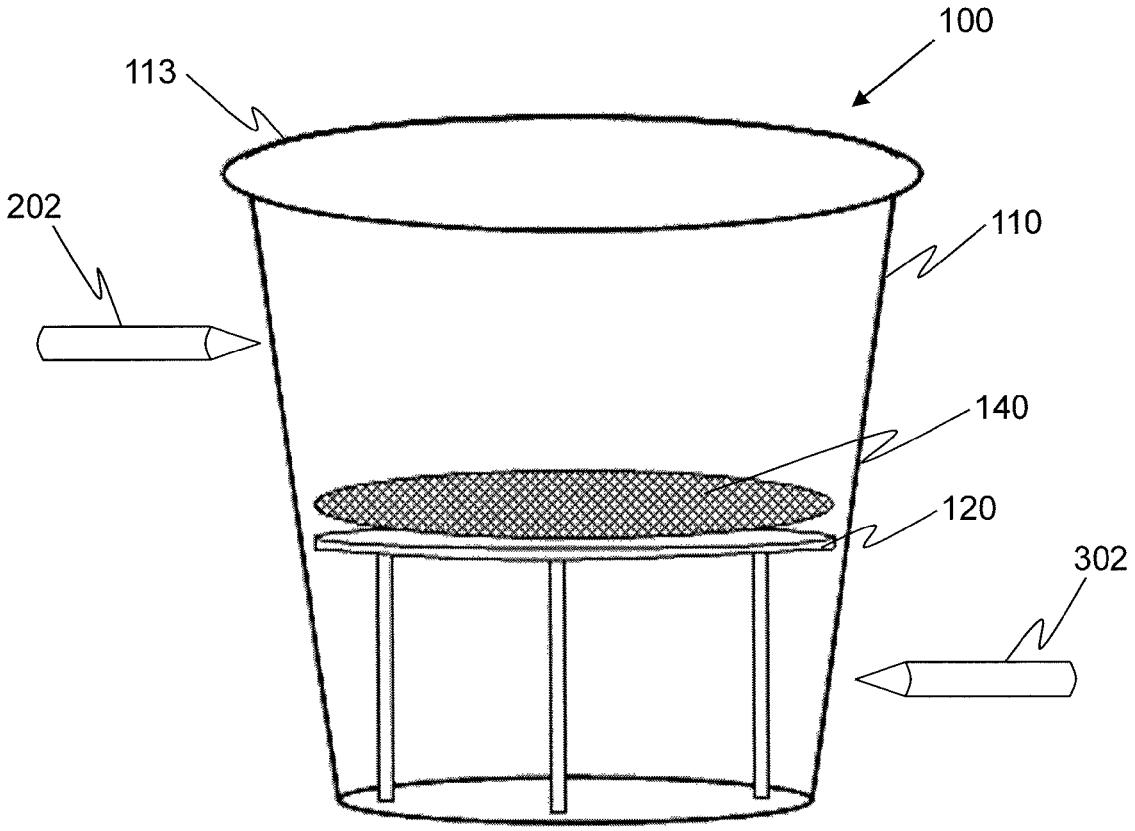
FIG. 3 is a front view of a different embodiment of the cartridge.

For injecting the liquid, in one embodiment, the lid 113 is piercable to form an inlet, which may be created by a first piercing tool 200, to accommodate the inflow of a liquid, such as water. In another embodiment, as shown in FIG. 3, one or more side walls 111 along the first portion 115 may be pierced using a first side piercing tool 202 to form the inlet.

For extracting the liquid, in one embodiment, the bottom surface 112 is piercable to form an outlet, which may be created by a second piercing tool 300, to accommodate the outflow of the beverage. In another embodiment, as shown in FIG. 3, one or more side walls 111 along the second portion 116 may be pierced using a second side piercing tool 302 to form the outlet.

Figure 4:
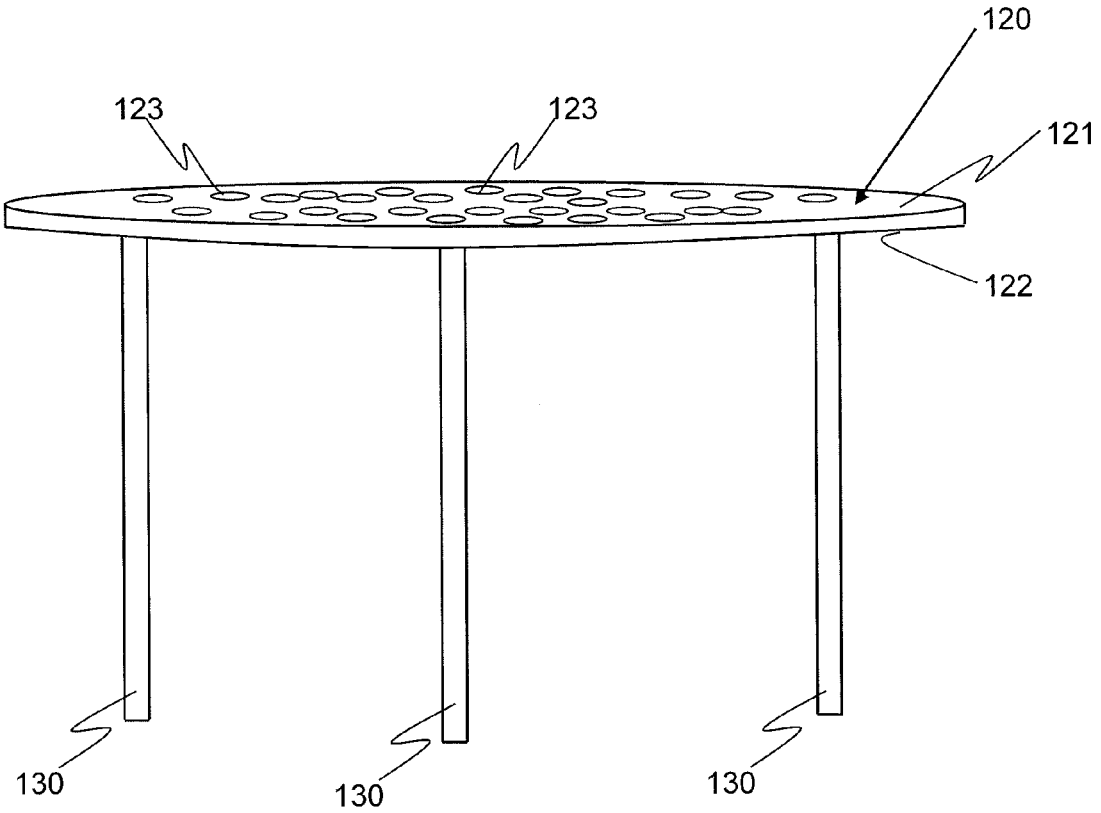
FIG. 4 is a front view of one embodiment of the separating element.
Figure 5:
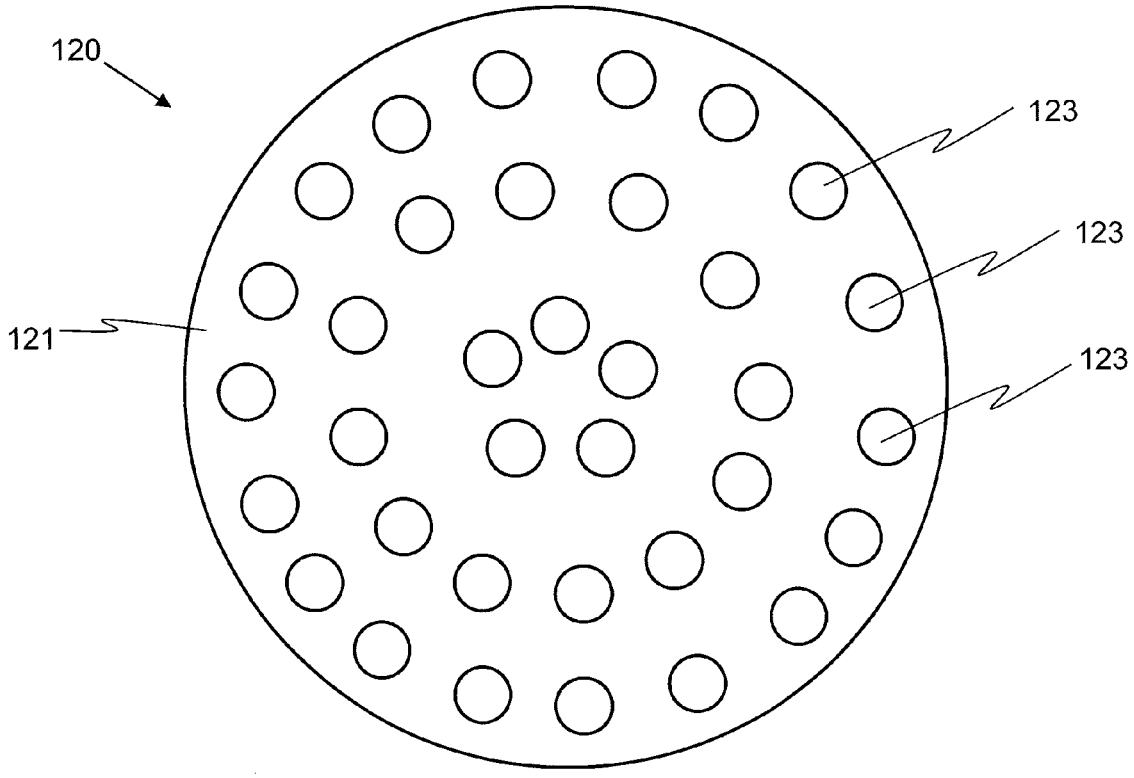
FIG. 5 is a top view of one embodiment of the separating element.
Figure 6:
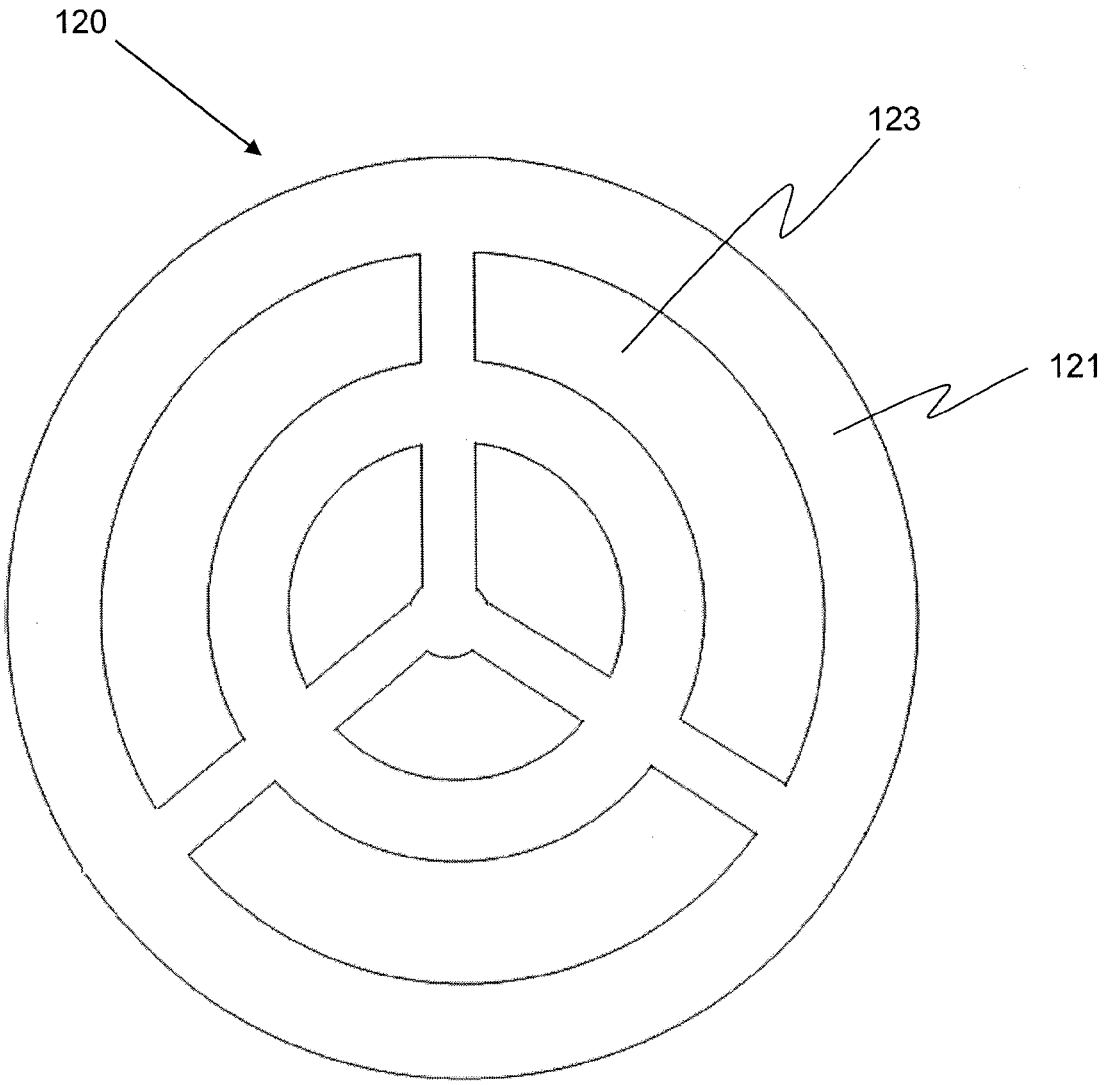
FIG. 6 is a top view of another embodiment of the separating element.

FIGS. 4, 5, and 6 show embodiments of the separating element 120. The separating element 120 comprises a first surface 121 sufficient to support the pod in the first portion 115 of the interior space 114. Generally, the separating element 120 extends toward the side walls 111, though not necessarily a snug fit along the side walls 111, as will be explained below.

The first surface 121 of the separating element 120 is generally shaped as a substantially planar surface to support the pod, while a second surface 122 on the opposing face of the separating element facing the second portion 115 of the interior space 114 need not have any specific shape as it does not need to support the pod.

The separating element 120 permits fluid communication from the first portion 115 to the second portion 116 of the interior space 114. In one embodiment, drainage passages 123 extend from the first surface 121 to the second surface 122, permitting fluid communication from the first portion 115 to the second portion 116 of the interior space 114. In another embodiment, fluid communication is achieved by forming the separating element 120 from a water permeable material. In yet another embodiment, fluid communication is achieved by forming the separating element 120 such that it is not a snug fit along all of the side walls 111 (such that its widest dimension is smaller than the adjacent dimension of the side walls of the container), thereby permitting fluid to pass between an edge of the separating element 120 and the one or more side walls 111.

The separating element elevates the pod so as to prevent damage to the pod due to contact with the piercing tool 300. Additionally, the first surface 121 of the separating element 120 supports the pod 140 which may assist to prevent tearing under the pressure of the injected liquid.

In one embodiment shown in FIG. 6, the separating element 120 comprises a plurality of concentric rings, joined by one or more spokes which extend radially from the centre of the rings toward the outermost ring, with the drainage passages 123 being the gaps between said rings. In a preferred embodiment, the separating element comprises two concentric rings joined by one or more spokes, the rings being separated by a distance greater than the width of a widest ring. It should be understood that individual spokes need not extend from the centre of the rings toward the outermost rings, but could instead by replaced by a set of discontinuous spokes joining the rings together in any way. It should also be understood that either the spokes or rings could be omitted to provide a non-unitary separating element, though such an embodiment may be more complex and costly.

Referring back to FIG. 4, the supporting elements 130 may be independent of the separating element 120 and/or cartridge 100, or they may be integral components of another element of the cartridge 100. For example, the supporting elements 130 may be formed with the separating element 120 or with the one or more side walls 111 of the container 110.

Figure 7:
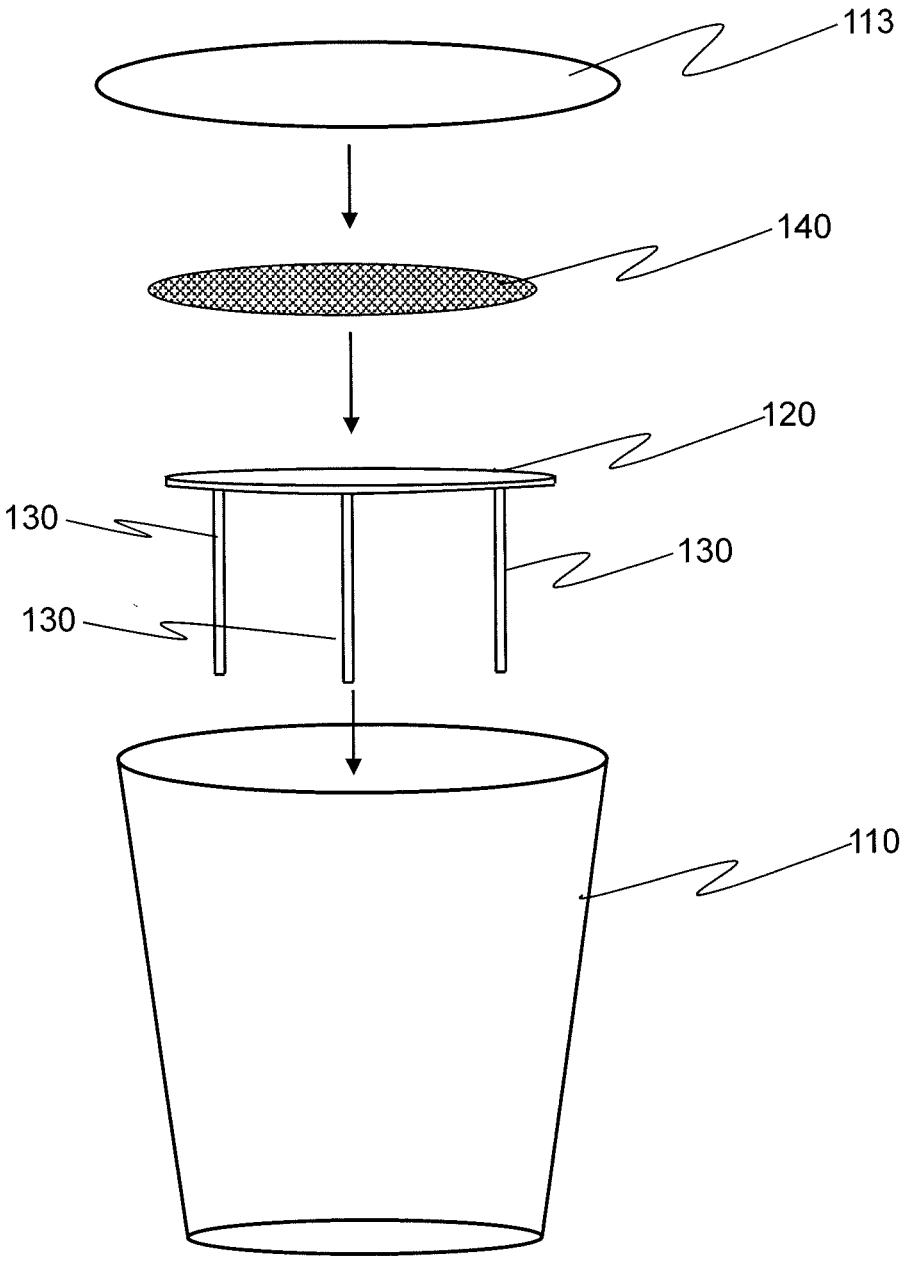
FIG. 7 is an exploded view of the cartridge and its components.

In a preferred embodiment, the supporting elements 130 are a set of at least three members integral with the separating element 120, extending from the second surface 122 of the separating element 120 toward the bottom wall 112. The integrated separating element 120 and supporting elements 130 are placed within the container, as shown in FIG. 7, resulting in the free ends of the supporting elements being aligned to abut the bottom surface 112 of the container 110, as shown in FIG. 1. The length of the supporting elements 130 determines the elevation of the separating element, and thereby also the distance that the pod is separated from the piercing tool 300. The supporting elements are of a length that they provide sufficient distance between piercing tool 300 and the separating element without moving the pod into near proximity with the first piercing tool 200.

Figure 8:
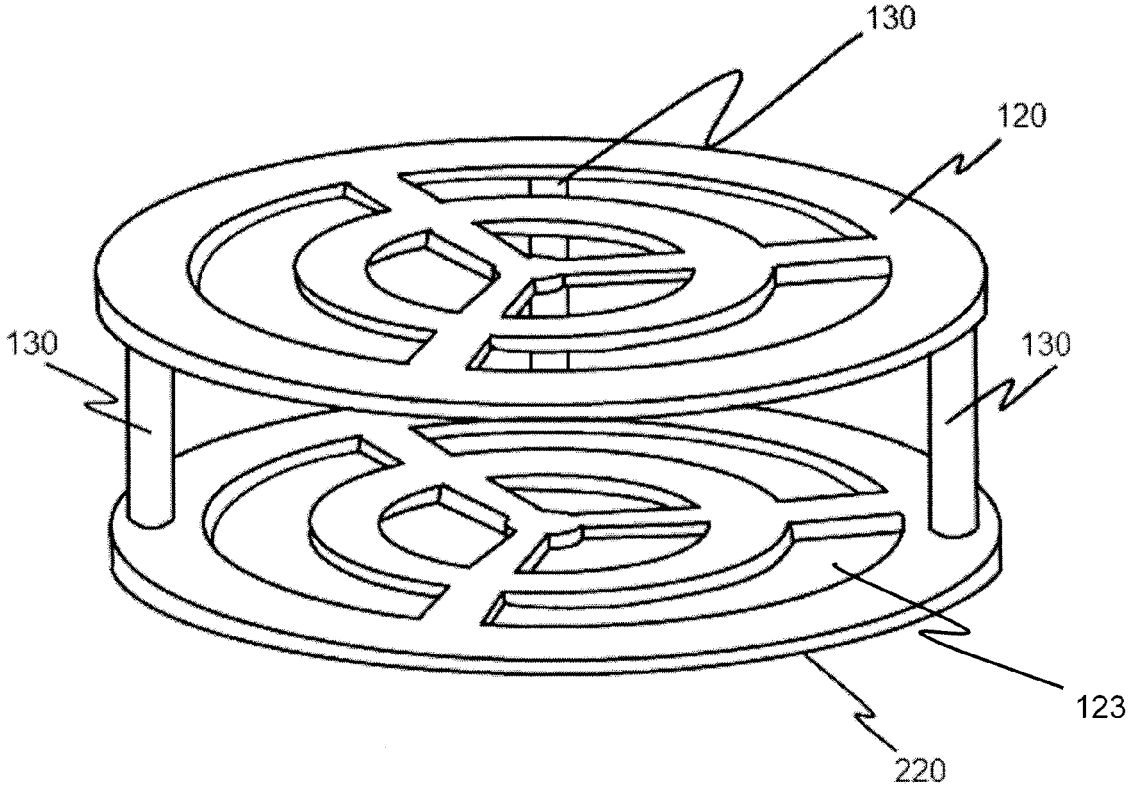
FIG. 8 is a front/top perspective view of another embodiment of the separating element.
Figure 9:
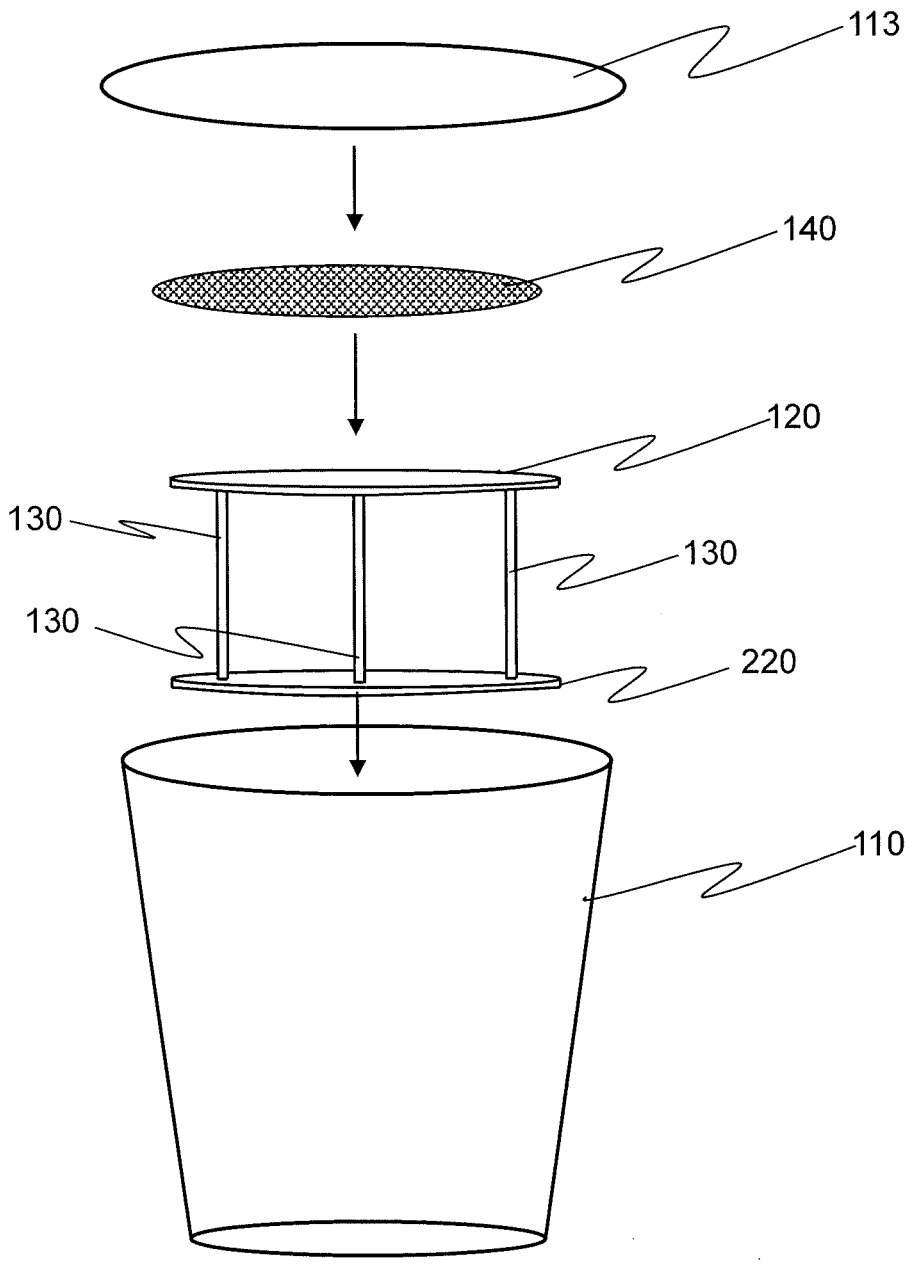
FIG. 9 is an exploded view of another embodiment of the cartridge and its components.

In another embodiment, as shown in FIGS. 8 and 9, a second separating element 220 is connected to the ends of the supporting elements 130 opposite the separating element 120. The second separating element 220 permits fluid communication from the second portion 116 to a beverage receptacle via an outlet formed by a piercing element. In the example of FIG. 8, the second separating element 220 has the same shape, structure, and drainage passage pattern as the separating element 120, which in this example, comprises a plurality of concentric rings and radial spokes, and drainage passages 123. It will be appreciated that the second separating element 220 may comprise of a different shape, structure, and/or drainage passage pattern than the separating element 120.

The second separating element 220 can facilitate the placement of a combined structure of the separating element 120, supporting elements 130 and second separating element 220 within the container 110, without having to specifically align the free ends of the supporting elements 130 to abut the bottom surface 112 of the container 110 such that the supporting element 120 is spaced apart from the bottom surface 112 of the container 110 (as shown in FIG. 7). In the example of FIG. 9, either separating element 120 or 220 can be aligned to abut the bottom surface 112 of the container 110, resulting in the other separating element to be spaced apart from the bottom surface 112 to support the pod 140. It will be appreciated that the second separating element 220 can perform the function of the separating element 120 to support the pod 140, when the separating element 120 is aligned to abut the bottom surface 112 of the container, resulting in the second separating element 220 to be spaced apart from the bottom surface 112 by supporting elements 130.

In an embodiment, the second piercing tool 300 can be aligned with the drainage passages 123 of the separating element abutting the bottom surface 112, so as to not pierce through the separating element. In another embodiment, the piercing tool 300 can pierce through the separating element abutting the bottom surface 112 when forming an outlet to the container 110. In another embodiment, the outlet can be formed along the side walls 111 using the second side piercing tool 302.

Referring back to FIG. 8, the supporting elements 130 may be independent of the separating elements 120 and 220, or they may be integral components of the separating element 120 and/or the second separating element 220. For example, the supporting elements 130 may be a set of a least three members formed integrally with the separating element 120, extending from the second surface 122 of the separating element 120 at one end to a surface of the second separating element 220 at its other end.

Figure 10:
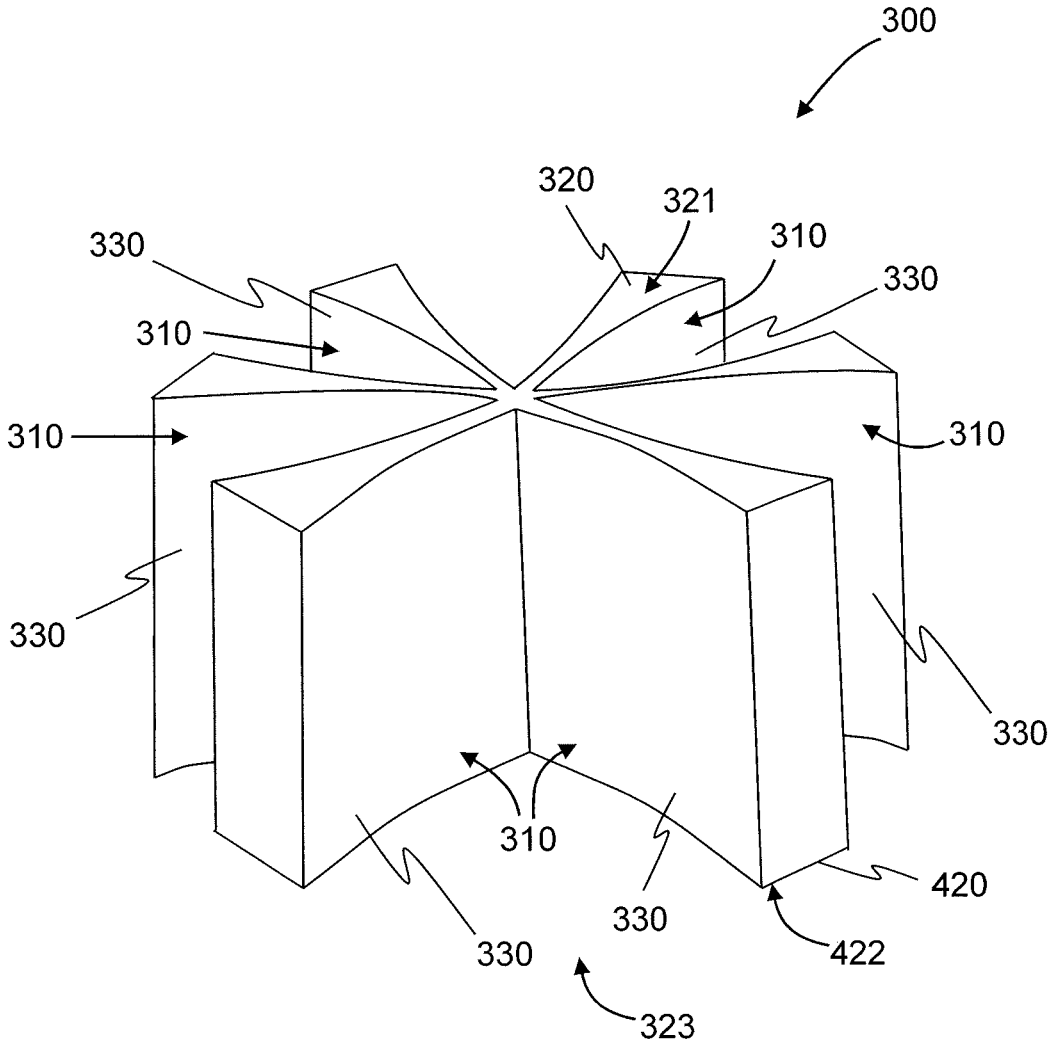
FIG. 10 is a front/top perspective view of another embodiment of the separating element.

Referring to FIG. 10, another embodiment of a separating element 320, supporting elements 330 and second separating element 420 is shown. FIG. 10 illustrates an example spacer 300 comprising a plurality of walls 310 interconnected with one or more other walls 310. In this example, the spacer 300 comprises six walls 310 connected at its centre to form a six-spoke star-shape. The supporting elements 330 comprise the walls 310, the separating element 320 comprises the first surface 321 formed by the top traverse edges of the walls 310, and the second separating element 420 comprises the second surface 422 formed by the bottom traverse edges of the walls 310.

When the spacer 300 is placed within the container 110, the separating element 320 or second separating element 420 can be aligned to abut the bottom surface 112 of the container 110, with the other separating element supporting a pod 140. The pod 140, when supported by the separating element 320 or second separating element 420, is spaced apart from the bottom surface 112 by the height of the walls 310. The interstitial spaces or gaps defined by adjacent walls 310 serve as drainage passages 323 for enabling fluid communication between the first surface 321 and the second surface 422. In another example, it will be appreciated that the number of walls 310 can differ from that shown in FIG. 10 (e.g. three walls 310 forming a three-spoke star-shaped spacer), and the walls 310 can be connected in other configurations to form different cross-sectional shapes of the spacer 300. One or more walls 310 may also have different thicknesses from other walls 310 and/or be non-uniform along a single wall 310. It will also be appreciated that the walls 310 can be integrally formed, or individual formed and then attached to other walls 310.

Figure 11:
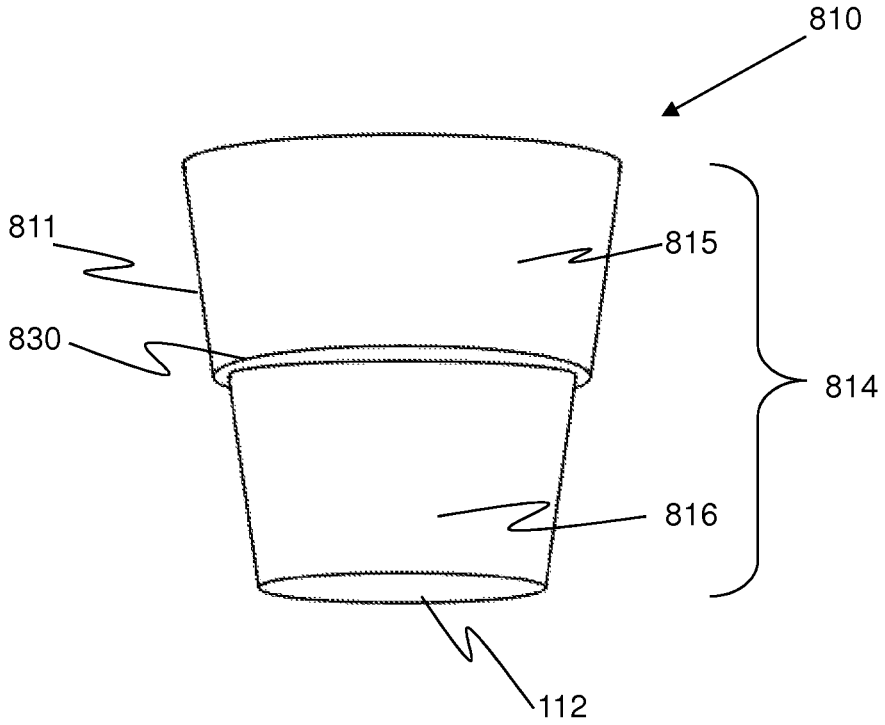
FIG. 11 is a front view of another embodiment of the container.
Figure 12:
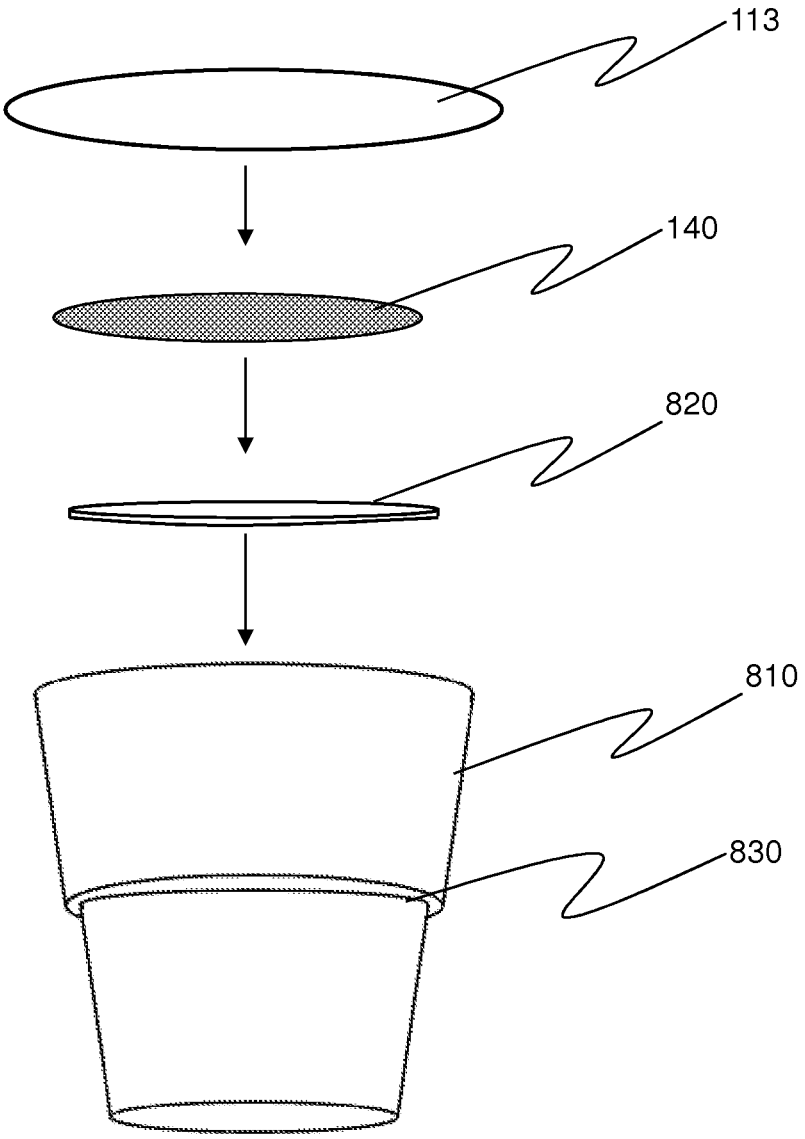
FIG. 12 is an exploded view of another embodiment of the cartridge and its components.

In another embodiment, as shown in FIGS. 11 and 12, the supporting element 830 is formed integrally with the container 810. The supporting element 830 may comprise one or more steps, ledges or protrusions protruding inwardly within the interior space 814, in the one or more side walls 811 of the container 810, producing a container within which the smallest diameter of the first portion 815 is greater than the largest diameter of the second portion 816. The separating element 820, which may be a disc, has a diameter equal to or slightly smaller than the smallest diameter of the first portion 815 of the container 810 and larger than the largest diameter of the second portion 816 of the container 810, thereby enabling the separating element 820 to rest on the step between the first and second portions.

The container 110 may be formed, typically, by deep drawing or injection moulding, of a heat resistant material which is impervious to water. In one embodiment, the container may be formed in two steps. The side walls 111 and the bottom surface 112 may be formed as a continuous piece, and the lid 113 may later be attached after the separating element 120 and pod have been inserted into the portion of the container comprising the side walls 111 and the bottom surface 112.

The separating element 120 may be formed separately from the container, and of a heat resistant material which is impervious to water. Preferably, the material is also sufficiently rigid to maintain a substantially parallel relationship among the major surfaces 121 and 122 of the separating element 120, the lid 113, and the bottom surface 112 of the container 110, while supporting the weight of both the liquid contained within the first portion 115 of the interior space 114 and the saturated pod 140, as well as the pressure from the injected liquid. That is, the separating element 120 should not deform under the pressure commonly experienced within the container 110, but should maintain a consistent relationship between the sides of the first and second portions 115 and 116 of the container 110, thereby preventing contact with the second piercing tool 300. The separating element 120 may be positioned on the supporting elements 130 within the container 110.

The lid 113 may be punched from a piercable material and heat sealed or otherwise adhered to the upper edge of the one or more side walls 111 of the container 110.

The cartridge 100 is hence manufactured by providing the separating element 120, providing the pod 140, placing the pod 140 on a major surface 121 or 122 of the separating element 120, and forming the container 110 around the separating element 120 and the pod 140.

In a preferred embodiment, the container 110 is initially only partially formed. For example, the lid 113 may be left unattached. A beverage additive may be placed on the bottom surface 112 of the container 110. The separating element 120 is placed within the partially formed container 110, over the beverage additive if present. The pod 140 is placed upon the separating element. The container is then completed by attaching the lid 113 to the side walls 111 thereby enclosing the separating element and the pod.

In use, the cartridge 100 is positioned in a beverage making machine, such as a single serving coffee brewer. The machine includes at least two piercing tools 200 and 300, which are directed towards the cartridge 100, and operated to create at least one inlet and at least one outlet in the container 110, in such a way as to provide access to both the first and second portions 111 and 112. Typically, the cartridge 100 is placed with the machine so that the lid of the cartridge is above the bottom surface of the cartridge, enabling the liquid to flow from the inlet to the outlet by a force at least partially due to gravity.

The pod 140 is supported in an advantageous position by the separating element 120, such that neither the first piercing tool 200 or the second piercing tool 300 contacts the pod 140. A liquid, water for example, is injected into the first portion 115 of the interior space 114 through an inlet created by the first piercing tool 200. The water passes through the pod 140 under high pressure and at high velocity, saturating the contents and extracting the aroma and flavour of the contents. Since the pod 140 is supported by the separating element 120, it is believed that the pod 140 will not tear due to the force of the injected liquid or the force applied on the pod by its own increased weight when saturated. The resulting beverage flows by gravity or another motive force through the drainage passages 123 of the separating element 120, into the second portion 116 of the container 110. If a beverage additive has been disposed between the separating element 120 and the bottom surface 112, the flavoured beverage mixes with the beverage additive. Finally, the beverage additive flows out of the outlet created by the second piercing tool 300. The beverage may then pass into a beverage collector of some form.

Figure 13:
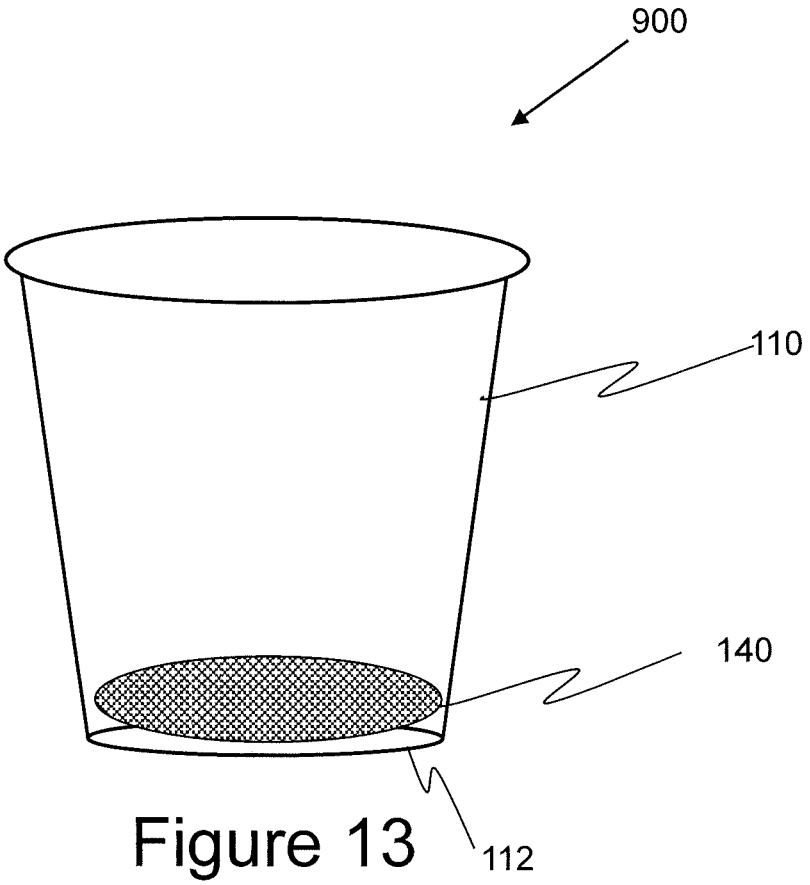
FIG. 13 is a front view of another embodiment of a cartridge.

In another embodiment, a cartridge 900 is shown in FIG. 13, comprising a container 110 that does not contain any separating elements or supporting elements to support a pod 140, such that the pod 140 can abut and lie on the bottom surface 112 of the container 110. The absence of separating elements and supporting elements may simplify the manufacturing process and/or costs to make the cartridge 900. In an example, at least a portion of the outer surface of the pod 140 may be made from material of sufficient resistance to tearing or piercing by a piercing tool (e.g. second piercing tool 300 shown in FIG. 1). In another example, only the portion of the pod 140 facing the bottom surface 112 of the container is made of material resistant to being pierced by the piercing tool.

Although the invention has been described with reference to certain specific embodiments, various modifications thereof will be apparent to those skilled in the art without departing from the invention.

What is claimed is:

1. A cartridge for preparing a beverage, the cartridge comprising:

a container comprising one or more side walls extending between a lid at one end and a bottom surface at a second opposing end defining an interior space;

a first separating element separately formed from the container and having a shape, a structure and a drainage passage pattern, the first separating element separating the interior space into first and second portions, the first separating element being supported within the container by one or more supporting elements at one end of the one or more supporting elements and constructed to permit fluid communication between the first and second portions;

a second separating element separately formed from the container and at the other end of the one or more supporting elements opposite the first separating element, the second separating element comprising the same shape, structure and drainage pattern as the first separating element; and a pod constructed of a fluid-permeable material containing a substance from which a beverage can be extracted, the pod being supported by the first separating element in the first portion and the second separating element being disposed in the second portion.

2. The cartridge according to claim 1, wherein the first separating element comprises drainage passages.

3. The cartridge according to claim 2, wherein the first separating element comprises a plurality of concentric rings, joined by one or more spokes.

4. The cartridge according to claim 3, wherein the first separating element comprises two concentric rings joined by one or more spokes, the rings being separated by a distance greater than the width of a widest ring.

5. The cartridge according to claim 1, wherein the one or more supporting elements are independent elements from the first separating element and the second separating element.

6. The cartridge according to claim 1, wherein the one or more supporting elements are an integral part of the first separating element and the second separating element.

7. The cartridge according to claim 6, wherein the one or more supporting elements comprise one or more members extending from a surface of the first separating element to the second separating element.

8. The cartridge according to claim 1, wherein the one or more supporting elements comprise a plurality of interconnected walls, the first separating element comprises first traverse edges of the plurality of interconnected walls and the second separating element comprises second traverse edges of the plurality of interconnected walls.

9. The cartridge according to claim 1, further comprising a beverage additive disposed in the second portion.

10. The cartridge according to claim 1, wherein the lid is formed separately from and affixed to the container.

11. The cartridge according to claim 1, wherein one or more of the lid, the bottom surface and the one or more side walls is pierceable to allow insertion of one or more piercing tools.

12. A method of manufacturing a cartridge for preparing a beverage, the method comprising:

providing a first separating element and a second separating element at opposite ends of one or more supporting elements, the first separating element having a shape, a structure and a drainage passage pattern, the second separating element comprising the same shape, structure and drainage pattern as the first separating element;

providing a pod constructed of a fluid-permeable material containing a substance from which a beverage can be extracted;

placing the pod on a surface of the first separating element; and forming a container around the first separating element, second separating element and the pod, the container comprising one or more side walls extending between a lid at one end and a bottom surface at a second opposing end defining an interior space, the interior space being separated into first and second portions by the first separating element such that the pod is supported by the first separating element in the first portion and the second separating element is disposed in the second portion, the first separating element constructed to permit fluid communication between the first and second portions.

13. The method of claim 12, wherein forming the container around the first separating element, second separating element and the pod comprises:

forming a first component of the container;

placing the first separating element, second separating element and the pod within the first component of the container;

forming a second component of the container; and affixing the second component of the container to the first component of the container.

14. The method of claim 12, wherein the first component comprises the one or more side walls and the bottom surface, and the second component comprises the lid.

15. The method of claim 12, further comprising disposing a beverage additive within the container between the bottom surface and the first separating element.

* * * * *